US006394426B1

(12) United States Patent
Galka et al.

(10) Patent No.: US 6,394,426 B1
(45) Date of Patent: May 28, 2002

(54) ENGINE DUAL FUEL SUPPLY APPARATUS

(75) Inventors: William E. Galka, Caro; Joseph M. Graham, Cass City; Anthony M. Kueffner, Caro; Peter P. Kuperus; Ronald H. Roche, both of Cass City, all of MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/612,076

(22) Filed: Jul. 7, 2000

(51) Int. Cl.[7] ..... F02M 7/12
(52) U.S. Cl. ..... 261/49; 261/51
(58) Field of Search ..... 261/22, 49, 51, 261/35, 69.1, 69.2, DIG. 23, DIG. 82, DIG. 68

(56) References Cited

U.S. PATENT DOCUMENTS

| | | | | | |
|---|---|---|---|---|---|
| 2,472,692 | A | * | 6/1949 | Brown | 261/51 X |
| 2,477,481 | A | * | 7/1949 | Ericson | 261/51 |
| 2,552,056 | A | * | 5/1951 | Orr, Jr. | 261/51 X |
| 2,621,029 | A | * | 12/1952 | Moseley | 261/51 X |
| 3,408,054 | A | * | 10/1968 | Walker | 261/51 X |
| 3,689,036 | A | * | 9/1972 | Kikuchi et al. | 261/69.2 X |
| 3,906,910 | A | * | 9/1975 | Szlaga, Jr. | 261/51 X |
| 4,055,609 | A | * | 10/1977 | Phelps | 261/51 X |
| 4,597,371 | A | | 7/1986 | Wissmann et al. | 123/495 |
| 4,700,668 | A | | 10/1987 | Schierling | 123/504 X |
| 4,861,522 | A | * | 8/1989 | Gerhardy et al. | 261/51 X |
| 5,250,233 | A | * | 10/1993 | Swanson | 261/51 X |
| 5,411,680 | A | * | 5/1995 | McCarthy et al. | 261/DIG. 68 |
| 5,554,322 | A | * | 9/1996 | Kobayashi | 261/51 X |
| 5,682,845 | A | | 11/1997 | Woody | 123/73 A |
| 6,059,271 | A | * | 5/2000 | Gerhardy | 261/35 |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

An engine fuel apparatus has a fuel and air mixing passage through which a rich fuel and air mixture is provided to an engine to support the operation of the engine at idle and low speed, low load engine operation, and a pressurized fuel delivery passage provides liquid fuel to a downstream fuel injector for operation of the engine at high load, high speed and wide open throttle engine operating conditions. A shut-off valve prevents the flow of fuel to the mixing passage when a throttle valve therein, which controls engine operation, is opened a predetermined amount from idle to prevent the flow of the fuel into the mixing passage at high load and/or high speed engine operation. Another shut-off valve prevents the flow of pressurized fuel to the downstream fuel injector device when the throttle valve is between idle and a predetermined position off of idle to prevent the flow of pressurized fuel to the fuel injector device under low speed, low load engine operation. Desirably, a camshaft rotated in response to rotation of the throttle valve is used to actuate both shut-off valves.

26 Claims, 4 Drawing Sheets

ENGINE DUAL FUEL SUPPLY APPARATUS

FIELD OF THE INVENTION

This invention relates generally to engine fuel systems and more particularly to an apparatus providing a dual fuel supply to an engine.

BACKGROUND OF THE INVENTION

Typically, carburetors have been used to supply a fuel and air mixture to both four stroke and two stroke small internal combustion engines. For many applications where small two stroke engines are utilized, such as hand held power chainsaws, weed trimmers, leaf blowers, garden equipment and the like, carburetors with both a diaphragm fuel delivery pump and a fuel metering system have been utilized. In operation, two stroke engines utilizing these carburetors have a relatively high level of hydrocarbon exhaust emissions which are detrimental to the environment and exceed and cannot meet the exhaust emission requirements imposed by the State of California and the emission requirements proposed by the Environmental Protection Agency of the United States government and the governments of several other countries.

Due to the relatively low selling price of small two stroke engines, and particularly two stroke engines for hand held power tools and the like, it is not economically feasible to utilize sophisticated electronic fuel injection systems such as those typically used for automotive vehicle applications. Components such as sensors, high precision fuel injectors, electric fuel pumps, fuel pressure regulators, and electronic control modules are prohibitive in cost and render the engine and fuel system too large for the small engine industry. Some pneumatic assisted fuel injection systems have improved the exhaust emissions at relatively low cost for various small engines. However, they require a compatible non-electronic fuel metering system and pressurized fuel delivery system to support the engine fuel requirements over its wide range of operating loads and conditions as well as the environmental conditions in which the engines are used.

SUMMARY OF THE INVENTION

A dual supply apparatus with a fuel and air mixing passage through which a rich fuel and air mixture is provided to an engine to support the operation of the engine at idle and low speed, low load engine operation, and a pressurized fuel delivery passage providing a metered flow of fuel to a fuel injector downstream of the apparatus which provides the fuel required by the engine at high load, high speed and wide open throttle engine operating conditions. A shut-off valve closes to prevent the flow of fuel into the mixing passage when a throttle valve, which controls engine airflow operation, is opened a predetermined amount from idle to prevent the flow of the fuel into the mixing passage at high load and/or high speed engine operation. Similarly, a fuel injector circuit shut-off valve closes to prevent the flow of pressurized fuel to the fuel injector when the engine throttle valve is between idle and a predetermined position off of idle to prevent the flow of pressurized fuel to the fuel injector under low speed, low load engine operation.

Desirably, a camshaft rotates in response to rotation of the throttle valve to actuate both the mixing passage fuel shut-off valve and the fuel injector shut-off valve. This provides a mechanical synchronization of the switching of the fuel delivery from the mixing passage circuit to the fuel injector circuit in response to the throttle valve position. To provide a smoother switching of the fuel delivery between these circuits, preferably the opening and closing of both valves overlaps so they are both open at the same time so some fuel is supplied to the engine by both circuits during valve transition.

Objects, features and advantages of this invention include providing an apparatus which provides a fuel and air mixture to the engine crankcase under at least some operating conditions for lubrication of the engine and to support engine operation, provides a pressurized supply of fuel to a fuel injector apparatus under at least some engine operating conditions to enable the injection of fuel into the combustion chamber of the engine, reduces the hydrocarbon emissions of the engine, improves the fuel economy, permits use of a relatively inexpensive fuel injector mechanism, provides a desired fuel and air mixture to the engine under a wide range of engine operating conditions, does not significantly increase the total package envelope of the engine, minimizes the number of ancillary engine components required for control of fuel delivery, enables adjustment for the transition between crankcase fuel circuit operation and fuel injector circuit operation, is adaptable to a variety of engines, may be used with engines equipped with direct fuel injection technology, provides a low cost metered fuel supply to the engine, is of relatively simple design and economical manufacture and assembly, is reliable, durable and has a long, useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENT

Figure 1:
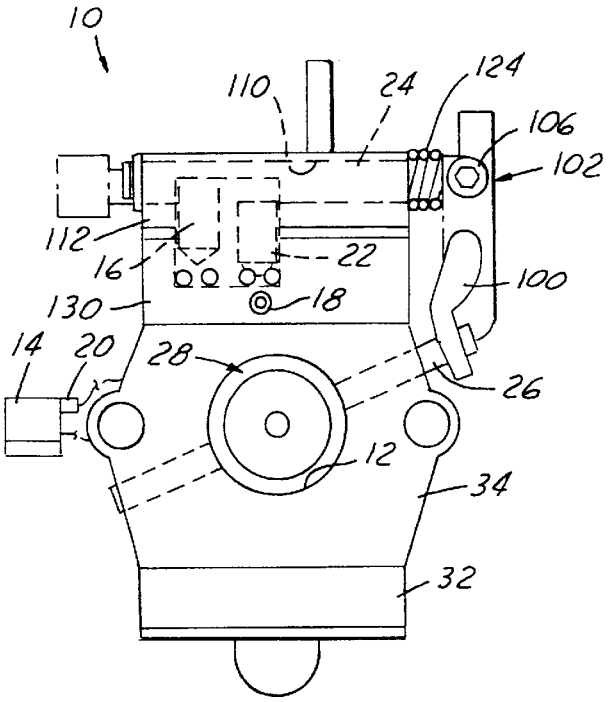
FIG. 1 is a schematic front view of an apparatus embodying the present invention and having a fuel injector circuit shut-off valve and a mixing passage fuel delivery shut-off valve which control the fuel delivery from the apparatus.

Referring in more detail to the drawings, FIGS. 1–7 illustrate an apparatus 10 having a fuel and air mixing passage 12 through which a fuel and air mixture is delivered to a crankcase of a 2-stroke internal combustion spark ignition engine 14, a fuel circuit shut-off valve 16 which controls the flow of fuel to the fuel and air mixing passage 12, a fuel injector circuit outlet passage 18 through which a supply of pressurized fuel is supplied to a fuel injector apparatus 20 for subsequent injection of the fuel into the engine and a fuel injector circuit shut-off valve 22 which controls the flow of fuel through the fuel injector delivery passage 18. Desirably, a camshaft 24 is mechanically linked to a shaft 26 of a throttle valve 28 for rotation with the throttle valve shaft 26 and is adapted to selectively drive the fuel injector circuit shut-off valve 22 and the mixing passage fuel circuit shut-off valve 16 between open and closed positions to control the flow of fuel from the apparatus 10. The fuel and air mixing circuit preferably provides the fuel required for operation of the engine 14 at idle and relatively low speed, low load engine operation. The fuel injector circuit preferably provides the fuel required for operation of the engine at high speed, high load conditions up to wide open throttle engine operation. However, other engine/injector apparatus configurations can be realized that may use a similar fuel injector circuit for both idle and low speed engine operating conditions controlled by the switching valve 16 in lieu of the fuel circuit providing fuel through the fuel and air mixing passage for idle/slow speed operation. To accomplish this, both shut-off valves 16, 22 control the flow of fuel to the fuel injector apparatus 20, with one valve 16 open to permit a metered fuel flow to the injector 20 at low engine speed and closed at high engine speed, and the other valve 22 closed at low engine speeds and open at higher engine speeds to provide fuel to the injector 20.

Fuel Pump

Figure 3:
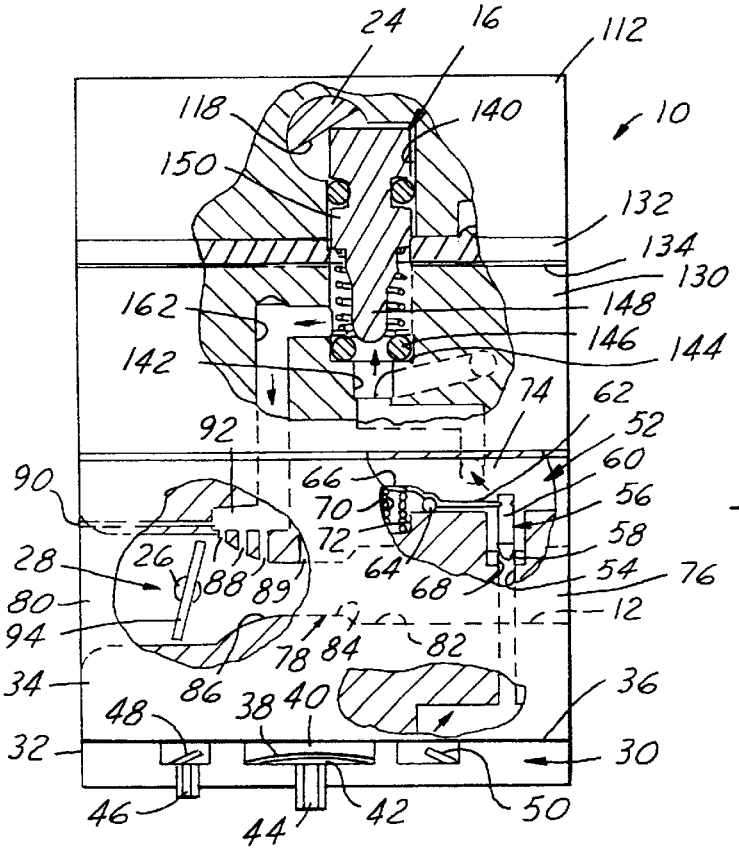
FIG. 3 is a schematic sectional view of the apparatus of FIG. 1 with portions broken away and in section illustrating the mixing passage fuel delivery circuit shut-off valve.

As shown in FIG. 3, the apparatus 10 has a fuel pump 30 defined between an end plate 32 and a main body 34 with a gasket 36 between them. The fuel pump 30 has a diaphragm 38 defining a fuel chamber 40 on one side and a crankcase pressure pulse chamber 42 on its other side communicating with the engine crankcase through a passage 44. Negative pressure pulses from the engine crankcase displace the diaphragm 38 in a direction tending to increase the volume of the fuel chamber 40 to draw fuel from a fuel tank through an inlet passage 46 in the end plate 32. A fuel inlet valve 48 which is preferably a flap type valve integral with the fuel pump diaphragm 38 is opened by the decreased pressure within the fuel chamber 40 to permit fuel flow therethrough and into the fuel chamber 40. A subsequently provided positive pressure pulse from the engine crankcase to the pressure pulse chamber 42 displaces the fuel pump diaphragm 38 in a direction tending to decrease the volume of the fuel chamber 40 to thereby increase the pressure of the fuel therein and to discharge it through an outlet valve 50. The outlet valve 50 is also preferably a flap type valve integral with the fuel pump diaphragm 38 and is opened by the increase in pressure in the fuel chamber.

Fuel Metering

Fuel discharged from the fuel pump outlet is delivered under pressure to a fuel metering assembly 52 of the apparatus 10 through a fuel metering inlet passage 54. The fuel metering assembly 52 functions as a vacuum actuated pressure regulator receiving pressurized fuel from the fuel pump 30 and regulating its pressure to a predetermined pressure, usually subatmospheric, to control the delivery of fuel from the fuel metering assembly 52. The assembly 52 has an inlet valve 56 with a needle shaped head 58 and a shaft 60 which is actuated by a lever arm 62 connected at one end to the valve, fulcrumed between its ends on a pin 64 and having a control finger 66 actuated at its free end by a fuel metering diaphragm (not shown). The inlet valve 56 is yieldably biased to its closed position bearing on a valve seat 68 by a coil spring 70 received in a pocket 72 of the body 34 and bearing on the finger 66 of the lever arm 62. As the pressure changes within a fuel metering chamber 74 defined on one side of the fuel metering diaphragm, the fuel metering diaphragm is displaced to bear on the finger 66 and hence rotate the lever arm 62 to cause a corresponding movement of the inlet valve 56 between its open and closed positions to selectively permit fuel to enter the metering chamber 74 through the inlet valve 56.

Fuel Mixture Circuit

The main body 34 of the apparatus 10 has the fuel and air mixing passage 12 formed therethrough. The fuel and air mixing passage 12 has an inlet portion 76 which leads to a venturi 78, which in turn leads to an outlet portion 80 through which a fuel and air mixture is delivered to the engine. The venturi 78 has a converging upstream portion 82 leading to a throat 84 of reduced diameter which in turn leads to a downstream diverging portion 86. A plurality of low speed fuel jets 88 open into to the fuel and air mixing passage 12 preferably in the diverging portion 86 or just downstream of the venturi 78. At least one high speed fuel jet 89 preferably opens into the throat 84. Fuel is provided from the fuel metering chamber 74 through the fuel circuit shut-off valve 16 to the fuel jets 88 and 89 for delivery into the fuel and air mixing passage 12 in response to a pressure differential across the fuel jets 88, 89. A conventional low speed fuel adjustment needle (not shown) may be contained in the body 34 for more precise adjustment of idle/slow speed fuel delivery, if desired. An air bleed 90 may extend from the downstream end of the fuel and air mixing passage 12 to a fuel progression pocket 92 which leads to the fuel jets 88. The air bleed 90 preferably bleeds air into the progression pocket at medium to high engine speed so that a leaner mixture of fuel and air is provided into the fuel and air mixing passage 12 when the throttle valve 28 is opened more than about 50% towards its wide open position.

Throttle & Shut-Off Valves

The throttle valve 28 is preferably a butterfly type valve having a disk shaped valve head 94 mounted on a shaft 26 rotatably carried in the body 34. The throttle valve 28 is moved from an idle position, as shown in FIG. 3, substantially preventing the flow of air through the fuel and air mixing passage 12, to a wide open throttle position wherein the valve head 94 is generally parallel with the fluid flow through the fuel and air mixing passage 12 to permit a substantially unrestricted fluid flow therethrough.

Figure 2:
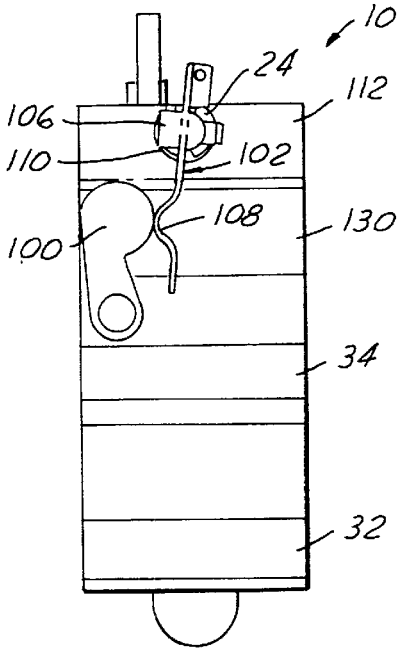
FIG. 2 is a side view of the apparatus of FIG. 1.
Figure 9:
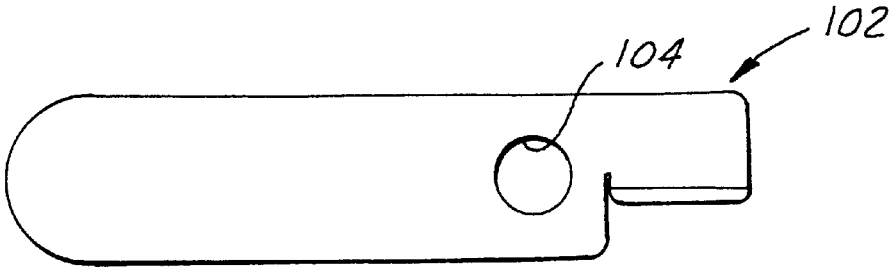
FIG. 9 is a plan view of a camshaft lever of the apparatus.
Figure 10:
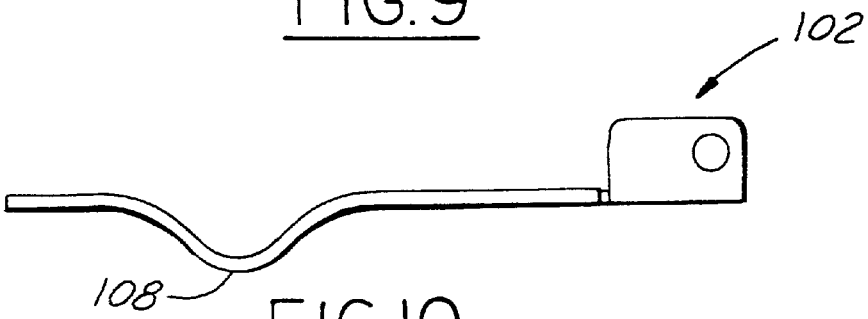
FIG. 10 is a side view of the apparatus lever of FIG. 9.
Figure 11:
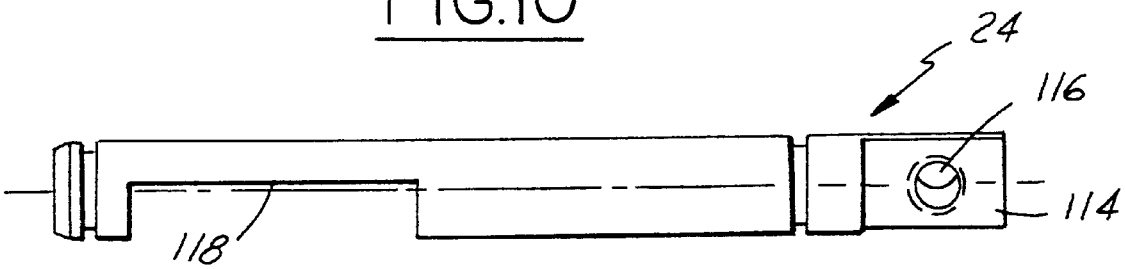
FIG. 11 is a side view of a camshaft of the apparatus.
Figure 12:
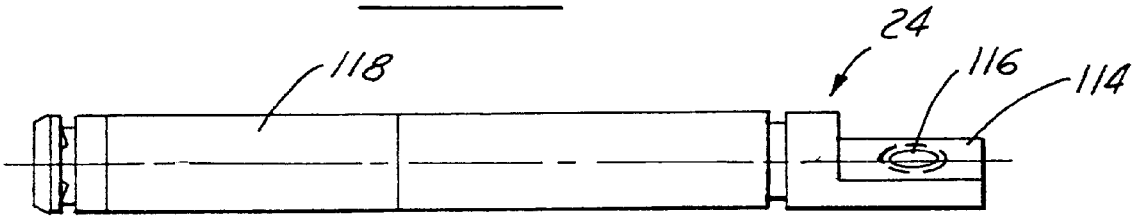
FIG. 12 is another side view of the camshaft of the apparatus.

As shown in FIGS. 1 and 2, the throttle valve shaft 26 extends out of the body 34 at one end and has a cam 100 on this end adapted to engage and displace a lever 102 attached to the camshaft 24 to cause rotation of the camshaft 24 during at least a portion of the rotation of the throttle valve shaft 26. As shown in FIGS. 9 and 10, the camshaft lever 102 is preferably a generally thin metallic arm with a through hole 104 which receives a cap screw 106 or other fastener to connect the lever 102 to the camshaft 24. The lever 102 preferably has a curved cam surface 108 between its ends which, as shown in FIG. 2, is adapted to engage the corresponding portion of the throttle valve shaft cam 100 when the throttle valve 28 is rotated sufficiently away from its idle position toward its wide open position. Rotation of the throttle valve shaft 26 from the idle position of the throttle valve 28 to its wide open position, causes the throttle valve shaft 26 and its cam 100 to rotate clockwise, as viewed in FIG. 2, and over at least a portion of this rotation causes a corresponding counterclockwise rotation of the camshaft lever 102 which in turn, causes a counterclockwise rotation of the camshaft 24.

Figure 4:
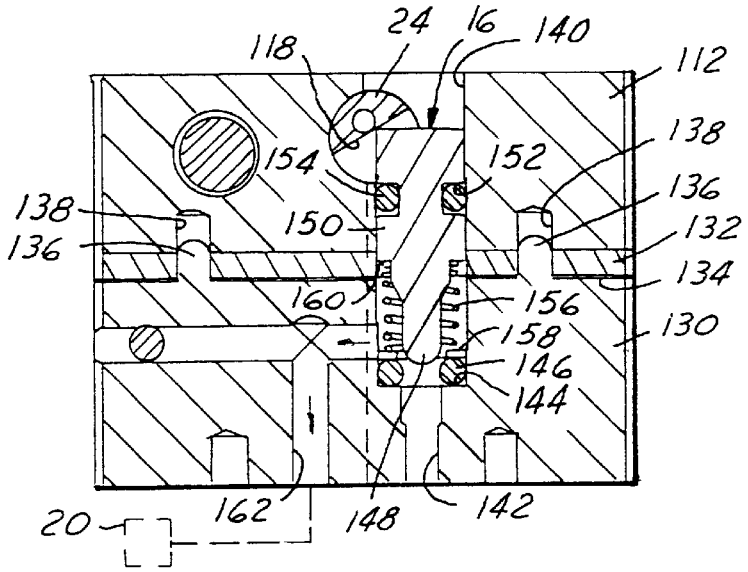
FIG. 4 is a fragmentary sectional view illustrating the position of the mixing passage fuel delivery circuit shut-off valve when the throttle valve is in its idle position.
Figure 6:
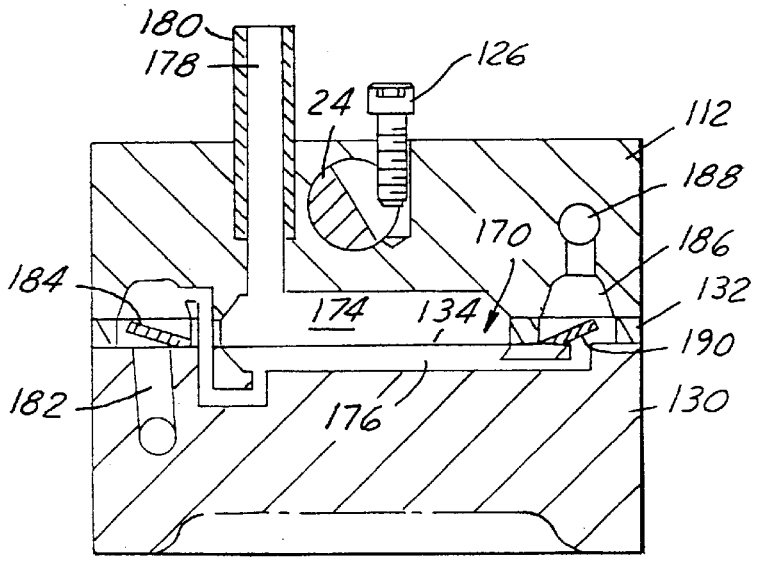
FIG. 6 is fragmentary sectional view illustrating a pump of the fuel injector delivery circuit.
Figure 7:
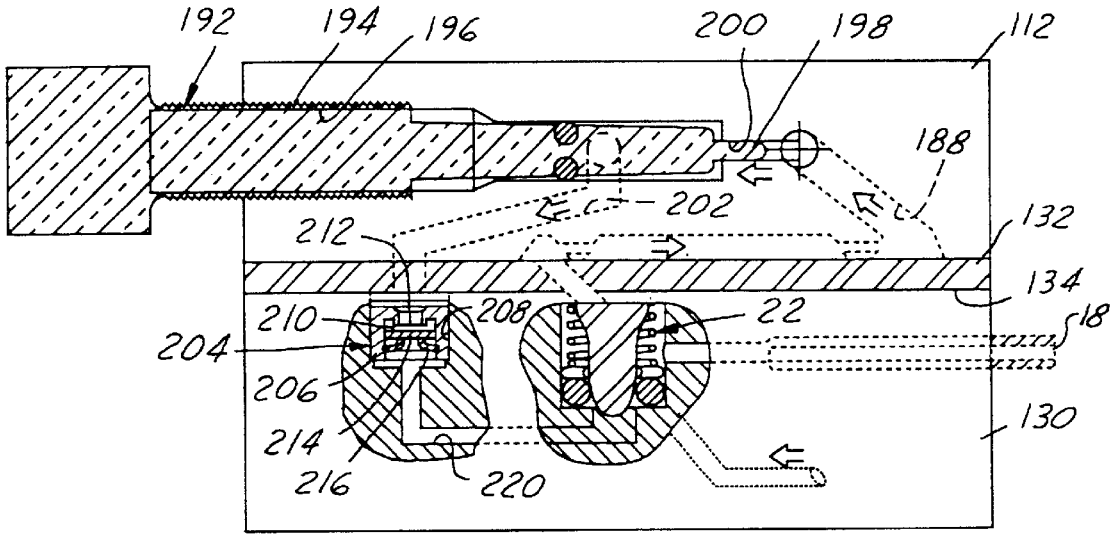
FIG. 7 is a fragmentary sectional view of the apparatus illustrating a fuel flow path through the fuel injector delivery circuit.

As shown in FIGS. 1, 2, 11 and 12, the camshaft 24 is preferably a generally cylindrical rod received in a complementary bore 110 in an upper plate 112 of the body 34 and has a machined flat 114 at one end with a hole 116 formed through this flat 114 adapted to receive the fastener 106 or other means of connection of the camshaft lever 102 thereto. A second machined flat 118 adjacent the other end of the camshaft 24 is adapted to selectively engage the fuel injector circuit shut-off valve 22 and the mixing passage fuel circuit shut-off valve 16 to move these valves 16,22 between their open and closed positions in response to the position of the throttle valve 28, which is controlled by the degree of rotation of the throttle valve shaft 26. As best shown in FIG. 1, a spring 124 is preferably received at one end of the camshaft between the camshaft lever and the body to yieldably bias the camshaft 24, and the camshaft lever 102 to their positions corresponding to the idle position of the throttle valve 28. As shown in FIG. 6, to limit the rotation of the camshaft, and hence, thereby limit the engagement of the camshaft with the shut-off valves to control the position of the shut-off valves in their fully closed position, adjustable screws 126 are received in the upper plate and are adapted to engage a portion of the camshaft 24 to limit its rotation. The upper plate 112 in which the camshaft 24 is carried is connected to an intermediate plate 130 which is in turn connected to the main body 34. A suitable gasket 132 and a fuel injector pump diaphragm 134 are disposed between the upper and intermediate plates 112, 130. As shown in FIG. 4, locating pegs 136 may extend from the intermediate plate 130 through openings in the diaphragm 134 and gasket 132 and into blind bores 138 in the upper plate 112 in assembly to maintain the relative position of the plates, diaphragm, and gasket.

Mixing Passage Fuel Shut-Off Valve

As shown in FIGS. 3 and 4, the mixing passage fuel circuit shut-off valve 16 is received in a generally cylindrical bore 140 extending through the upper plate 112, gasket 132, diaphragm 134 and into the intermediate plate 130. A passage 142 opening into this bore 140 communicates the fuel metering chamber 74 with the shut-off valve 16 and defines an annular shoulder 144 on which an O-ring 146 or other annular sealing member is provided to define a valve seat.

The shut-off valve 16 has a valve head 148 adapted to be received and to seal against the O-ring 146 defining the valve seat and an enlarged diameter body 150 extending from the valve head 148 and having an annular groove 152 constructed to receive an O-ring 154 to provide a fluid tight seal between the valve body 150 and the bore 140 of the upper plate 112 to prevent fluid leakage between them. A coil spring 156 is preferably disposed around the valve head 148 and bears on a washer 158 disposed on the valve seat 146 at one end and an annular shoulder 160 of the valve body 150 at its other end to yieldably bias the shut-off valve 16 to its open position with the valve head 148 spaced from the valve seat 146 to permit fluid flow past the valve head 148. The spring 156 preferably also maintains the valve body 150 in contact with the camshaft so that it is responsive to camshaft rotation. The spring force on the washer 158 also maintains the O-ring 146 on the bottom or shoulder of the bore 140 to prevent leakage into the bore 140 around the O-ring 146. The end of the valve body 150 opposite the valve head 148 engages the camshaft 24 in the area of its second flat 118 and rotation of the camshaft 24 drives the shut-off valve 16 from its open position to its closed position preventing fluid flow through the valve seat 146.

The shut-off valve 16 controls the flow of fuel from the fuel metering chamber 74 in the main body 34, through the passage 142 formed in the intermediate plate 130 which extends from the fuel metering chamber 74, through the valve seat 146, and to another passage 162 leading to the fuel progression pocket 92 within the main body 34 to provide fuel to the various fuel jets 88 and 89 opening into the fuel and air mixing passage 12. Thus, when the shut-off valve 16 is in its open position with its valve head 148 spaced from its valve seat 146, the fuel metering chamber 74 is communicated with the fuel and air mixing passage 12. When the shut-off valve is in its closed position preventing fluid flow through the valve seat 146, the fuel and air mixing passage 12 is not in communication with the fuel metering chamber 74 and thus, essentially no fuel is supplied through the fuel and air mixing passage 12 when the shut-off valve 16 is in its fully closed position. Alternatively, as shown in phantom in FIG. 4, the passage 162 may communicate with the fuel injector apparatus 20 if it is desired to provide fuel to the engine through the injector apparatus 20 at low engine operative speeds.

Fuel Injector Circuit

As shown in FIG. 6, the fuel injector circuit preferably has a second fuel pump 170 with a diaphragm 134 between the intermediate plate 130 and upper plate 112 and constructed to provide a supply of pressurized fuel to the fuel injector 20 downstream of the apparatus 10. The diaphragm 134 is trapped between the gasket 132 and the intermediate plate 130 to define a crankcase pressure pulse chamber 174 on one side of the diaphragm 134 and a fuel chamber 176 on the other side of the diaphragm 134. A passage 178 defined in part by a fitting 180 carried by the upper plate 112 communicates the engine crankcase chamber with the pressure pulse chamber 174 to actuate the second fuel pump diaphragm 134. A fuel passage 182 communicates the fuel metering chamber 74 with the pump fuel chamber 176 through an inlet valve 184, which is preferably a flap type valve integral with the second fuel pump diaphragm 134. An outlet passage 186 communicates fuel discharged from the fuel chamber 176 with a fuel passage 188. Fluid flow through the outlet is controlled by an outlet valve 190 which is preferably a flap type valve integral with the second fuel pump diaphragm 134.

When a negative pressure from the engine crankcase is communicated with the pressure pulse chamber 174, the diaphragm 134 is displaced in a direction tending to increase the volume of the fuel chamber 176 thereby decreasing the pressure in the fuel chamber 176. The decreased pressure in the fuel chamber 176 draws fuel from the fuel metering chamber 74 through the connecting passage 182 and into the fuel chamber 176. A subsequent positive pressure pulse from the engine crankcase displaces the second fuel pump diaphragm 134 in a direction tending to decrease the volume of the fuel chamber 176 thereby increasing the pressure therein and discharging fuel through the outlet passage 186 to the fuel passage 188. Thus, the second fuel pump 170 operates in a similar manner to the first fuel pump 30 to draw fuel into its fuel chamber 176 and to discharge fuel from the fuel chamber under pressure. In a currently preferred embodiment, the fuel discharged through the fuel outlet passage is at a pressure of between 2 and 5 psi. Drawing fuel from the metering chamber 74 provides enhanced fuel pressure stability independent of fuel tank pressure, atmospheric conditions, or changes in storage tank fuel level.

Fuel discharged under pressure from the fuel pump 170 flows through the fuel passage 188 to a fuel adjustment valve 192 (FIG. 7) which restricts the flow of fuel through the fuel injector delivery circuit. The fuel adjustment valve 192 preferably has a threaded shank portion 194 received in a complimentary threaded counterbore 196 in the upper plate 112 so that it may be rotated to vary the axial position of a needle shaped valve head 198 relative to a valve seat 200 in the upper plate 112. The valve head 198 is moved relative to the valve seat 200 to control the size of an annular flow area between them to provide an adjustable restriction to the fuel flow therethrough. Fuel which flows past the valve head 198 flows through a passage 202 extending from the bore in which the valve 192 is received, through the gasket 132 and diaphragm 134, to a check valve 204 disposed in the intermediate plate 130.

The check valve 204 isolates the portion of the fuel injector circuit upstream thereof from any external pressure variations experienced at or caused by the downstream fuel injector device 20. As shown, the check valve 204 is located upstream of the fuel injector circuit shut-off valve 22 but may be located downstream thereof or externally of the apparatus 10 such as in a fuel supply line between the apparatus and the downstream fuel injector device 20. The check valve 204 has a housing 206 fitted into a counterbore 208 in the intermediate plate 130 and an annular valve seat 210 defining a flow orifice 212, a flat disk 214 adapted to bear on the valve seat 210 to close the flow orifice 212 and a retainer 216 which positions and retains the disk 214 inside the housing 206. Calibrated holes may be provided through the disk 214 to leak or bleed a controlled pressure back into the fuel injector circuit to lower the differential pressure across the metering valve head 198 and valve seat 200. The check valve 204 must have a low inertia to facilitate opening and closing the check valve 204 with an operational frequency response as high as 180 cycles per second and is preferably made from suitably durable materials such as Mylar or other plastic composites.

Figure 5:
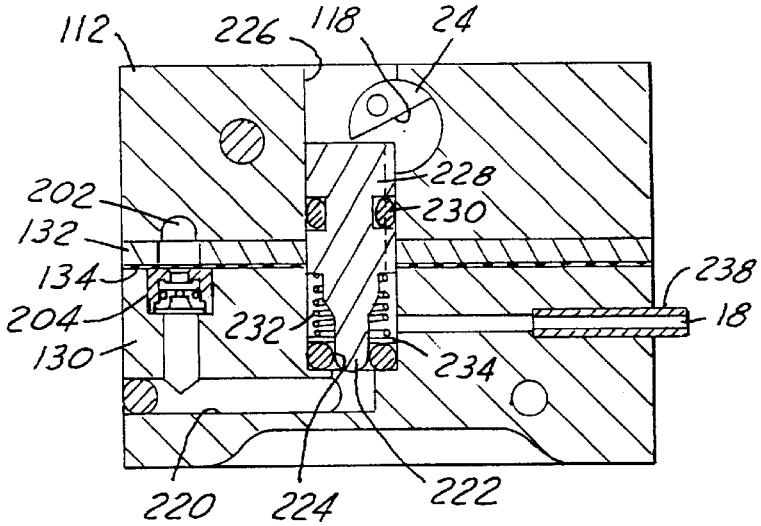
FIG. 5 is a fragmentary sectional view illustrating the fuel injector circuit shut-off valve when the throttle valve is in its idle position.

Fuel which flows through the check valve 204 enters a passage 220 which communicates with the fuel injector circuit shut-off valve 22. The fuel injector circuit shut-off valve 22 is constructed substantially the same as the mixing passage fuel circuit shut-off valve 16 and, as best shown in FIG. 5, has a cylindrical valve head 222 selectively engageable with a valve seat 224 defined by an O-ring received in the bore 226 in which the shut-off valve 22 is received. The valve head 222 has a reduced diameter relative to a valve body 228 extending therefrom and which carries an O-ring 230 to provide a fluid tight seal between the shut-off valve 22 and the upper plate 112 to prevent fluid leakage between them. A spring 232 disposed between the valve body 228 and a washer 234 bearing on the valve seat O-ring 224 yieldably biases the body 228 of the shut-off valve 22 to its open position permitting fluid flow through the valve seat 224 and preferably maintains the valve body 228 in contact with the camshaft. The spring 232 also seals the O-ring 224 against the bore 226. When the throttle valve 28 is in its idle position, and the camshaft 24 is in its corresponding position, as shown in FIG. 5, the body 228 of the shut-off valve 22 is engaged by the camshaft 24 and moved to its fully closed position to substantially prevent fluid flow through its valve seat 224. When the shut-off valve 22 is at least partially open, fuel may flow through the valve seat 224, past the valve head 222 and to the fuel injector circuit outlet passage 18 defined in part by an outlet fitting 238 carried by the intermediate plate 130 which communicates with the downstream fuel injector device 20. Therefore, pressurized fuel discharged from the outlet of the second fuel pump 170 is provided to a downstream fuel injector device 20 through outlet passage 18 when the fuel injector circuit shut-off valve 22 is open and the pressure at the fuel injector device 20 is less than the fuel pump 170 outlet pressure. A pressure at the fuel injector device 20 which is higher than the fuel pump outlet pressure will close the check valve 204 to prevent reverse flow through the outlet passage 18.

Figure 8:
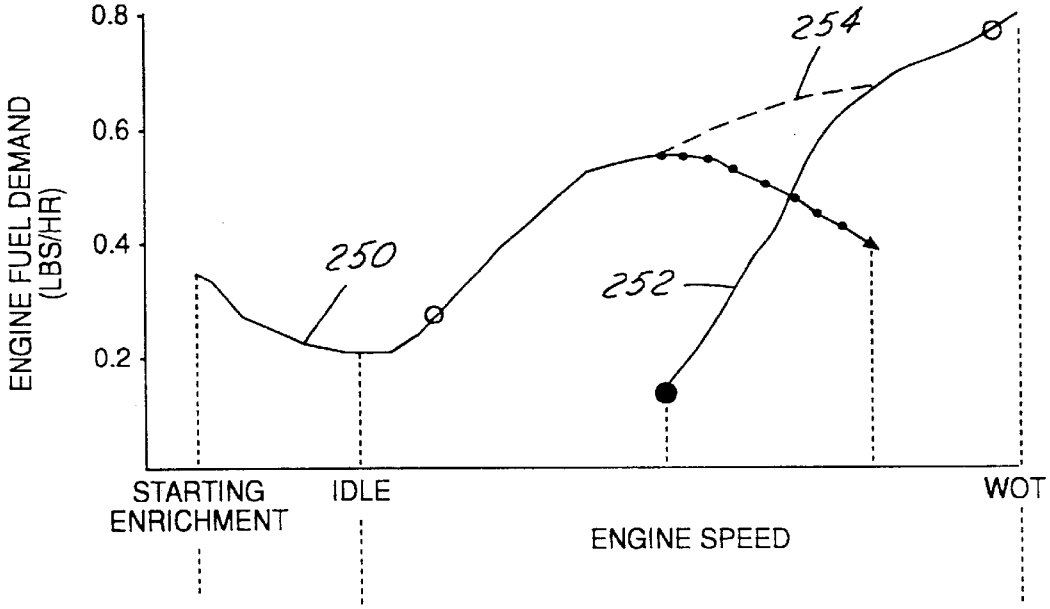
FIG. 8 is a graph of the engine fuel demand versus engine speed and illustrating the relative fuel supplies to the engine of the mixing passage fuel delivery circuit and the fuel injector circuit.

Operation of the apparatus 10 on an engine is illustrated in FIG. 8 which plots engine fuel demand versus engine speed. The fuel supplied by the mixing passage circuit is shown by a line 250 and the fuel supplied by the fuel injector circuit is shown by a line 252. As shown, a greater quantity of liquid fuel is provided to the engine during starting of the engine than at idle (which may be accomplished with a conventional choke valve arrangement), to facilitate starting of the engine and subsequent warming up of the engine. After the engine has warmed up, a relatively low quantity of fuel is required for steady state operation of the engine at idle. At idle, as previously described, the mixing passage fuel circuit shut-off valve 16 is in its open position permitting fuel to flow therethrough to the fuel and air mixing passage 12 whereupon it is combined with air flowing through the passage 12 and delivered to the engine 14. At the same time, the camshaft 24 is engaged with the fuel injector circuit shut-off valve 22 to close it, and prevent fuel from being delivered to the fuel injector apparatus 20 so that no fuel is supplied through the fuel injector apparatus 20 to the engine 14 under startup and idle conditions.

As the throttle valve 28 is opened from its idle position towards its wide open position to increase the engine speed, an increased flow of air passes through the fuel and air mixing passage 12, an increased pressure drop exists across the fuel jets 88, and an increased amount of liquid fuel is drawn into the fuel and air mixing passage for delivery to the engine, as indicated by line 250. Up to a predetermined throttle valve position or degree of opening, the mixing passage fuel circuit shut-off valve 16 remains essentially fully open and the fuel injector circuit shut-off valve 22 remains fully closed to prevent fuel flow therethrough. At a predetermined degree of opening of the throttle valve 28, desirably when the throttle valve 28 is rotated between 30% and 90% of the total rotational angle between its idle and wide open positions, and more desirably when it is rotated at least 50% towards its wide open position, the cam 100 engages the lever 102 to begin rotation of the camshaft 24 and thereby begin to close the mixing passage circuit shut-off valve 16 and to open the fuel injector circuit shut-off valve 22. The majority of the fuel supplied to the engine is still supplied through the fuel and air mixing passage circuit with a relatively minor fuel flow delivered to the injector and subsequently to the engine.

Continued rotation of the throttle valve 28 causes a continued rotation of the camshaft 24 which further opens the fuel injector circuit shut-off valve 22 and begins to close the mixing passage shut-off valve 16 to increase the flow of fuel through the fuel injector shut-off valve 22 and decrease the flow of fuel through the mixing passage fuel circuit shut-off valve 16. Eventually, upon sufficient rotation of the throttle valve 28, the mixing passage fuel circuit shut-off valve is fully closed to prevent fuel flow therethrough. Desirably, the mixing passage fuel circuit shut-off valve 16 is fully closed when the throttle valve 28 is rotated at least 50% , and preferably between 70% to 90% towards its wide open position. The range of overlap wherein the mixing passage fuel circuit shut-off valve 16 and the fuel injector circuit shut-off valve 22 are both at least partially open, is illustrated by a dashed line 254 in FIG. 8 which represents the combined fuel delivered by the apparatus through both the fuel and air mixing passage 12 and the fuel outlet passage 18. This range may correspond to a range of movement of the throttle valve of between 0% and 30% of the total rotation of the throttle valve 28, as desired. The switch from mixing passage fuel delivery to fuel injector fuel delivery is facilitated by the air bleed 90 which provides air into the progression pocket 92 to reduce the flow rate of liquid fuel into the fuel and air mixing passage 12 as the fuel discharged from the fuel outlet passage 18 is being increased. Continued opening of the throttle valve 28 to its wide open throttle position rotates the camshaft 24 to fully open the fuel injector circuit shut-off valve 22 and fully close the mixing passage circuit shut-off valve 16 so that all the fuel is supplied through the fuel injector apparatus 20 to the engine at high engine speed high load operation and wide open throttle engine operating conditions.

Therefore, the apparatus 10 controls the flow of both a fuel and air mixture to the two-stroke engine crankcase and a separate, pressurized fuel supply to a fuel injector device on the engine to support operation of the engine. Desirably, the fuel supplies are linked to the throttle valve 28 and are automatically controlled by shut-off valves 16,22 according to the position of the throttle valve 28 to provide the desired fuel flow rate to the engine over a wide range of operating conditions. The synchronization or relative opening and closing of the shut-off valves 16,22 can be controlled in a variety of ways. The adjustment screws 126 can be adjusted to limit the rotation of the camshaft 24, the position of the camshaft 24 in the apparatus 10 can be changed, more than one camshaft can be provided, the location and/or size of the valve bodies can be changed, the engagement between the cam 100 and lever 102 can be modified, to name a few of the ways to vary the output characteristics of the apparatus 10. Further, the apparatus 10 may be used to supply fuel to substantially any fuel injector device 20 including the direct injection arrangement disclosed in U.S. patent application, Ser. No. 09/764,701, filed on Jan. 18, 2001 and claiming the benefit of U.S. Provisional Patent Application Serial No. 60/178,429, filed Jan. 27, 2000, among other pneumatic, electronic, mechanical or other type injection systems for all modes of fuel injected operation including idle and slow speed conditions.

Finally, while the apparatus 10 has been described with reference to a mechanical linkage between the throttle valve 28 and the shut-off valves 16,22, the shut-off valves 16,22 could also be driven between their open and closed positions by a pneumatic or other fluid signal, or an electronic signal such as through a solenoid type valve.

What is claimed is:

1. An engine fuel apparatus comprising:

a body having a fuel and air mixing passage through which a fuel and air mixture is delivered to an engine and a fuel outlet passage through which liquid fuel is discharged to support engine operation;

a throttle valve carried by the body having a shaft and a valve head carried by the shaft, disposed in the fuel and air mixing passage and rotatable between idle and wide open positions;

a first valve carried by the body in communication with the fuel and air mixing passage for movement between an open position permitting fuel flow to the fuel and air mixing passage and a closed position at least partially restricting fuel flow to the fuel and air mixing passage to control the amount of fuel delivered to the fuel and air mixing passage;

a second valve carried by the body in communication with the fuel outlet passage for movement between an open position permitting fuel flow to the fuel outlet passage and a closed position at least partially restricting fuel flow to the fuel outlet passage to control the amount of fuel discharged from the fuel outlet passage; and a mechanical linkage which selectively moves both the first valve and second valve between their open and closed positions in response to movement of the throttle valve between its idle and wide open positions to control the fuel delivered to both the fuel and air mixing passage and the fuel outlet passage as a function of the throttle valve position.

2. The apparatus of claim 1 wherein the mechanical linkage moves the first valve to its closed position and permits the second valve to be in its open position when the throttle valve is in its wide open position.

3. The apparatus of claim 1 wherein when the first valve and second valve are in their closed positions they substantially prevent fluid flow to the fuel and air mixing passage and the fuel outlet passage, respectively.

4. The apparatus of claim 1 wherein the mechanical linkage comprises a camshaft carried for rotation by the body and selectively engageable with both the first and second valves to move them between their open and closed positions as the camshaft rotates, a lever connected to the camshaft, and a cam carried by the throttle valve shaft and constructed to engage the lever during at least a portion of the rotation of the throttle valve to rotate the camshaft.

5. The apparatus of claim 4 wherein when the throttle valve is in its idle position, the camshaft bears on and closes the second valve and when the throttle valve is in its wide open position, the camshaft bears on and closes the first valve.

6. The apparatus of claim 4 wherein the camshaft has at least one flat formed therein which is adapted to engage at least one of the first valve and second valve.

7. The apparatus of claim 6 wherein said one flat of the camshaft engages both the first valve and second valve.

8. The apparatus of claim 1 which also comprises a fuel pump having an inlet in communication with a supply of fuel and an outlet in communication with the fuel outlet passage through the second valve to provide a supply of pressurized fuel to the fuel outlet passage at least when the second valve is open.

9. The apparatus of claim 1 wherein the first valve has an annular valve seat through which fuel flows to the fuel outlet passage, a valve head which engages the valve seat when the first valve is in its closed position to at least substantially prevent fluid flow through the valve seat and a spring yieldably biasing the first valve to its open position.

10. The apparatus of claim 1 wherein the first valve is fully open when the second valve is fully closed and the first valve is fully closed when the second valve is fully open, and both the first and second valves are at least partially open at the same time when the throttle valve is in a predetermined position so that fuel is delivered through both the fuel and air mixing passage and the fuel outlet passage at least when the throttle valve is in said predetermined position.

11. The apparatus of claim 1 wherein the first valve is fully open when the throttle valve is in its idle position and is fully closed when the throttle valve is rotated between 30% and 90% of the angular distance towards its wide open position.

12. The apparatus of claim 11 wherein the first valve is closed when the throttle valve is rotated more than 50% towards its wide open position.

13. The apparatus of claim 10 wherein the first valve and second valve are both at least partially open over a range of throttle valve opening up to 30% of the total angular movement of the throttle valve beginning at a predetermined throttle valve position.

14. The apparatus of claim 8 wherein the fuel pump has a diaphragm carried by the body to define a fuel chamber on one side and a pressure pulse chamber on its other side in communication with a crankcase chamber of an engine to provide a pressure signal to the pressure pulse chamber to actuate the diaphragm.

15. The apparatus of claim 14 wherein the fuel pump discharges fuel from its outlet at a pressure of between 2 and 5 psi.

16. The apparatus of claim 12 wherein the first valve is closed when the throttle valve is rotated 70% to 90% towards its wide open position.

17. The apparatus of claim 1 which also comprises an air bleed passage communicating at one end downstream of the throttle valve and at its other end with a fuel passage through which fuel is delivered to the fuel and air mixing passage to provide air into the fuel when the throttle valve is rotated more than 50% from its idle position towards its wide open position to reduce the flow rate of liquid fuel into the fuel and air mixing passage.

18. The apparatus of claim 4 wherein the camshaft is yieldably biased to a position corresponding to the idle position of the throttle valve.

19. The apparatus of claim 8 which also comprises a check valve downstream of the fuel pump outlet which permits fluid flow from the fuel pump through the check valve and prevents reverse fluid flow to isolate the fuel pump from pressure variations downstream of the check valve.

20. An engine fuel apparatus comprising:

a body having a fuel and air mixing passage through which a fuel and air mixture is delivered to an engine and a fuel outlet passage through which liquid fuel is discharged to support engine operation;

a throttle valve carried by the body having a shaft and a valve head carried by the shaft, disposed in the fuel and air mixing passage and rotatable between idle and wide open positions;

a first valve carried by the body in communication with the fuel and air mixing passage for movement between an open position permitting fuel flow to the fuel and air mixing passage and a closed position at least partially restricting fuel flow to the fuel and air mixing passage to control the amount of fuel delivered to the fuel and air mixing passage;

a second valve carried by the body in communication with the fuel outlet passage for movement between an open position permitting fuel flow to the fuel outlet passage and a closed position at least partially restricting fuel flow to the fuel outlet passage to control the amount of fuel discharged from the fuel outlet passage; and a linkage which controls movement of both the first and second valves between their open and closed positions as a function of the position of the throttle valve to control the fuel delivered from the fuel and air mixing passage and the fuel outlet passage.

21. An engine fuel apparatus, comprising:

a body having a fuel and air mixing passage through which a fuel mixture is delivered to an engine and a second fuel passage through which liquid fuel is discharged to support engine operation;

a throttle valve carried by the body having a shaft and a valve head carried by the shaft, disposed in the fuel and air mixing passage and rotatable between idle and wide open positions;

a camshaft carried by the body and driven for rotation in response to at least a portion of the movement of the throttle valve between its idle and wide open positions;

a first shut-off valve carried by the body and selectively engageable with the camshaft to be driven by the camshaft during at least a portion of the camshaft rotation between an open position permitting fuel flow to the fuel and air mixing passage and a closed position at least partially restricting fuel flow to the fuel and air mixing passage to control the amount of fuel delivered to the fuel and air mixing passage; and a second shut-off valve carried by the body and selectively engageable with the camshaft to be driven by the camshaft during at least a portion of the camshaft rotation between an open position permitting fuel flow to the second fuel passage and a closed position at least partially restricting fuel flow to the second fuel passage to control the amount of fuel discharged from the second fuel passage.

22. The apparatus of claim 21 which also comprises a lever connected to the camshaft and a cam connected to the throttle valve shaft for co-rotation with the throttle valve shaft and constructed to engage and displace the camshaft lever during a portion of the rotation of the throttle valve shaft to cause a corresponding rotation of the camshaft.

23. An engine fuel apparatus comprising:

a body having a fuel outlet passage through which liquid fuel is discharged to support engine operation;

an air passage in the body through which air is delivered to the engine;

a throttle valve carried by the body having a shaft and a valve head in the air passage, carried by the shaft and rotatable between idle and wide open positions;

a first valve carried by the body in communication with the fuel outlet passage for movement between an open position permitting fuel flow from a supply of fuel to the fuel outlet passage and a closed position at least partially restricting fuel flow to the fuel outlet passage;

a fuel pump having an inlet configured to communicate with a supply of liquid fuel and an outlet of pressurized fuel;

a second valve carried by the body in communication with the outlet of the fuel pump and the fuel outlet passage for movement between an open position permitting pressurized liquid fuel flow from the fuel pump to the fuel outlet passage and a closed position at least partially restricting the pressurized liquid fuel flow to the fuel outlet passage; and a mechanical linkage which selectively moves both the first valve and second valve between their open and closed positions in response to movement of the throttle valve between its idle and wide open positions to control the fuel delivered to the fuel outlet passage as a function of the throttle valve position so that when the throttle valve is between its idle position and a position between its idle and wide open positions the first valve is open and the second valve is closed, and when the throttle valve is between its wide open position and a position between its idle and wide open positions the first valve is closed and the second valve is open.

24. The apparatus of claim 23 wherein the fuel pump discharges fuel from its outlet at a pressure in the range of 2 to 5 psi.

25. The apparatus of claim 23 wherein the fuel pump has a diaphragm carried by the body to define a fuel chamber on one side and a pressure pulse chamber on its other side configured to communicate with a crankcase chamber of an engine to provide a pressure signal to the pressure pulse chamber to actuate the diaphragm of the fuel pump.

26. The apparatus of claim 25 wherein the fuel pump discharges fuel from its outlet at a pressure in the range of 2 to 5 psi.

* * * * *